US006966843B2

(12) United States Patent
Rankin et al.

(10) Patent No.: US 6,966,843 B2
(45) **Date of Patent: *Nov. 22, 2005**

(54) GOLF CLUB FITTING SYSTEM AND METHOD

(75) Inventors: David Benjamin Rankin, Winston-Salem, NC (US); James Whittle Kluttz, Winston-Salem, NC (US)

(73) Assignee: Accu-Sport International, Inc., Winston-Salem, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 116 days.

(21) Appl. No.: 09/305,396

(22) Filed: May 5, 1999

(65) Prior Publication Data

US 2002/0072429 A1 Jun. 13, 2002

Related U.S. Application Data

(60) Provisional application No. 60/084,379, filed on May 6, 1998.

(51) Int. Cl.[7] ..... A63B 53/12

(52) U.S. Cl. ..... 473/202; 473/409; 473/407

(58) Field of Search ..... 473/219–223, 473/287, 289, 409, 407, 168–170, 151–155, 131, 266; 199/287; 151/288; 706/45; 434/252

(56) References Cited

U.S. PATENT DOCUMENTS

| | | | | |
|---|---|---|---|---|
| 4,898,388 A | | 2/1990 | Beard, III et al. | |
| 5,303,924 A | | 4/1994 | Kluttz et al. | |
| 6,083,123 A | * | 7/2000 | Wood | 473/409 |

* cited by examiner

*Primary Examiner*—Glenn Caldarola
*Assistant Examiner*—Tom P Duong
(74) *Attorney, Agent, or Firm*—Alston & Bird LLP

(57) ABSTRACT

A method and system is therefore provided for fitting a set of golf clubs to a particular golfer. In particular, the club fitting method and system assists a golfer in the selection of a set of golf clubs by providing objective indicia or scores representative of the manner in which the golfer hits golf shots with each of a number of different golf clubs. The club fitting method and system provide the golfer with numerical values representative of the consistency and performance of the golf shots made with a particular golf club, typically on an automatic basis. Based upon the relative numerical values representative of the consistency and performance of the golf shots made with a number of different golf clubs, the golfer can select the set of golf clubs which provides the combination of consistency and performance that is best suited for the golfer's game.

12 Claims, 8 Drawing Sheets

GOLF CLUB FITTING SYSTEM AND METHOD

RELATED APPLICATION

The present application is related to and claims priority from U.S. Provisional Application Ser. No. 60/084,379, filed May 6, 1998, the contents of which are incorporated herein in their entirety.

FIELD OF THE INVENTION

The present invention relates generally to golf club fitting systems and methods and, more particularly, to an automated golf club fitting system that measures a number of parameters associated with a golf shot and that determines the consistency and/or performance of the golfer with a respective golf club.

BACKGROUND OF THE INVENTION

Golfers can currently select from a wide variety of golf clubs produced by a number of different golf club manufacturers. According to the advertisements, each different set of golf clubs offers some advantage, such as less weight, a stiffer shaft, an enlarged head, peripheral weighting, etc. The variety of golf clubs is at least partly due to the longstanding debate as to whether the performance of a golf club, i.e., the distance with which a golfer can hit a golf ball with the golf club, or the consistency of a golf club, i.e., the accuracy with which a golfer can hit a golf ball with the golf club, is more important. As might be expected, a number of golf clubs are therefore currently available that emphasize performance, a number of golf clubs are currently available that emphasize consistency and a number of golf clubs are currently available that are advertised to provide both performance and consistency.

Typically, a highly skilled golfer will prefer a golf club capable of the greatest performance since the skill of the golfer can compensate for any inconsistency or inaccuracy. Conversely, a less proficient player will generally select a club that provides greater consistency and greater accuracy even though the golfer may not hit the golf ball as far with the particular club. Even within these general categories, however, a wide variety of golf clubs are available. As such, a golfer oftentimes has difficulty in determining which set of golf clubs would be most appropriate for their game.

In order to assist golfers in selecting the appropriate set of golf clubs for their game, many golf professionals offer club fitting services. Most club fitting services involve a golfer hitting several shots from a tee box at a practice range with each of a number of different clubs of the same type. Although shots can be hit for club fitting purposes with any of the clubs, a golfer typically hits several shots with each of a number of different 5 irons. A 5 iron is generally selected for club fitting purposes since the shots hit with a mid-iron, such as a 5 iron, are likely to be somewhat representative of shots hit with other clubs of the same set. Based upon the shots hit at the practice range, the golf professional and the golfer would typically discuss the manner in which the golfer had hit shots with each of the clubs. Based on these conversations, the golfer could then select the set of clubs which appeared to best fit their game.

As will be apparent, conventional techniques for club fitting involve extremely subjective judgments, both on the part of the golfer and the golf professional. As such, the golfer will not necessarily select the proper set of clubs for their game since the subjective judgments are often based upon the appearance or feel of the various sets of golf clubs as opposed to the manner in which the golfer hits golf shots with the sets of golf clubs. As a result of the relatively high cost of a set of golf clubs, the selection of a set of clubs which is not properly fit to the golfer's game will not only limit the golfer's game, but may also prove to be a costly mistake if the golfer decides that they must purchase yet another set of clubs in order to improve their game.

SUMMARY OF THE INVENTION

The present invention therefore provides an improved method and system for fitting a set of golf clubs to a particular golfer. In particular, the club fitting method and system of the present invention assists a golfer in the selection of a set of golf clubs by providing objective indicia or scores representative of the manner in which the golfer hits golf shots with each of a number of different golf clubs. Preferably, the club fitting method and system of the present invention provide the golfer with numerical values representative of the consistency and performance of the golf shots made with a particular golf club. Based upon the relative numerical values representative of the consistency and performance of the golf shots made with a number of different golf clubs, the golfer can select the set of golf clubs which provides the combination of consistency and performance that is best suited for the golfer's game.

According to one advantageous embodiment of the present invention, the club fitting method and system includes means for determining a number of parameters associated with each golf shot. These parameters can either be measured, such as by means of a radar device which measures launch parameters and/or an impact determination system which primarily measures landing parameters. As with conventional club fitting techniques, the golfer would generally make several shots with each of a number of different golf clubs. As such, the club fitting method and system of the present invention preferably includes means for determining the average and/or the standard deviation for respective ones of the parameters associated with the golf shots made by the golfer with each different golf club.

The club fitting method and system of this embodiment also includes means for determining, typically on an automatic basis, a consistency score and a performance score for a respective golf club based upon the parameters associated with the plurality of golf shots made with the respective club. Preferably, the consistency score is based at least partially upon the standard deviations for respective ones of the parameters associated with the plurality of golf shots made with the respective club. In contrast, the performance score is preferably based at least partially upon the averages for respective ones of the parameters associated with the plurality of golf shots made with the respective club. Typically, the club fitting method and system includes means for normalizing and weighting the averages and the standard deviations for respective ones of the parameters based upon the relative importance of the parameters prior to determining the consistency score or the performance score.

Based upon the consistency scores and/or the performance scores of the golf shots hit by the golfer with each of a number of different clubs, the golfer can select the golf club or the set of golf clubs that best suits the golfer's game on a more objective basis than provided by conventional club fitting techniques. Armed with the new set of clubs, the golfer's game should improve since the selected set of clubs fits the particular golfer's game.

According to another aspect of the present invention, the club fitting method and system includes means for automatically determining that the golfer has hit a sufficient number of shots with a particular club in order to properly determine the consistency and/or performance provided by the particular club. More particularly, the club fitting method and system of this embodiment automatically determines that a sufficient number of shots have been made with the respective golf club based, at least in part, upon at least some of the parameters associated with each golf shot. The club fitting method and system of this aspect of the present invention also includes means for providing an indication to the golfer that a sufficient number of golf shots has been made with the particular club.

Preferably, the means for automatically determining that a sufficient number of golf shots has been made includes means for determining a validity score for a respective golf club that is at least partially based upon standard deviations of respective ones of the parameters associated with the plurality of golf shots made with the respective club. In addition, the means for automatically determining that a sufficient number of golf shots have been made with a respective golf club also includes means for comparing the validity score to a predefined threshold to determine if a sufficient number of golf shots have been made with the respective golf club. Typically, the predefined threshold varies in a predetermined manner, such as a linearly decreasing manner, based upon the number of golf shots that have been made with the respective golf club. In addition, the club fitting method and system of this embodiment preferably requires at least a predetermined minimum number, but no more than a predetermined maximum number of golf shots to be made with the respective golf club, irrespective of the validity score. As such, the club fitting method and system of this aspect of the present invention can prevent the golfer from hitting an excessive number of shots with each of the clubs, thereby potentially tiring the golfer. As a result, the golfer is hopefully in the same general physical condition at the end of the club fitting session as at the beginning of the club fitting session such that the results, i.e., the consistency and performance scores, are not skewed by changes in the physical condition of the golfer.

DETAILED DESCRIPTION OF THE PRESENT EMBODIMENT

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
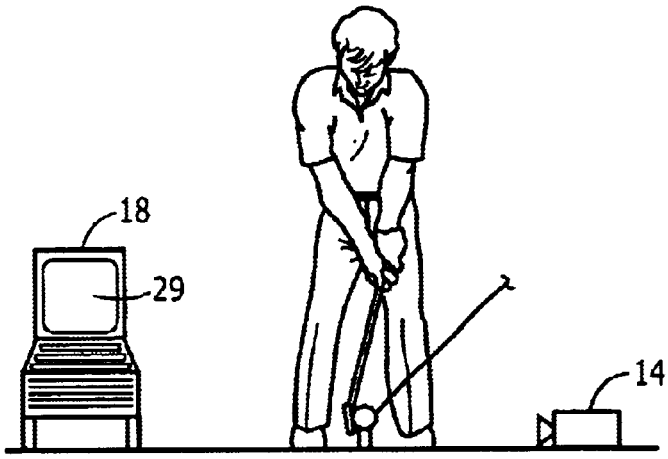
FIG. 1 is a perspective view of a tee box, such as at a practice range, which illustrates one exemplary means, such as a radar device, for measuring a number of parameters associated with a golf shot.
Figure 2:
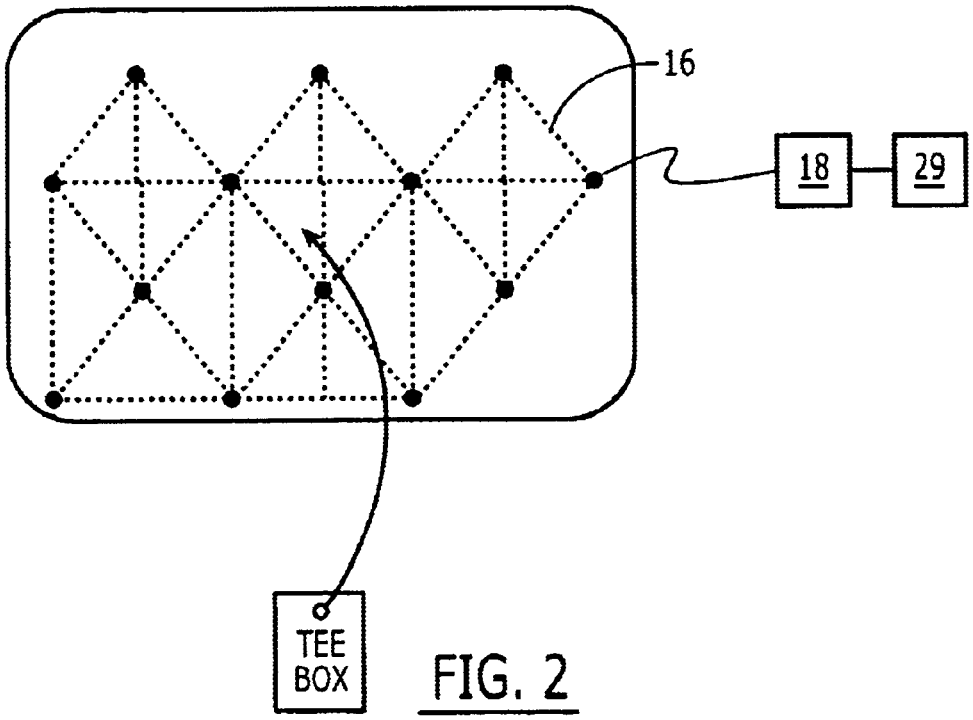
FIG. 2 is a plan view of a practice range having a tee box, a landing area and a system for detecting the impact location of a golf ball.

As described below and as shown in FIGS. 1 and 2, the club fitting method and system 10 of the present invention is particularly well suited for analyzing the golf shots taken at a practice range. However, the club fitting method and system of the present invention can analyze golf shots taken at other locations without departing from the spirit and scope of the present invention. Accordingly, the club fitting method and system of the present invention is preferably portable such that the club fitting method and system can be carried to the practice range or the like, such as in a briefcase.

As known to those skilled in the art, club fitting typically involves a golfer hitting several shots with each of several different clubs of the same type. For example, a golfer would typically hit several shots with each of several different 5 irons in the course of a club fitting session.

Figure 3:
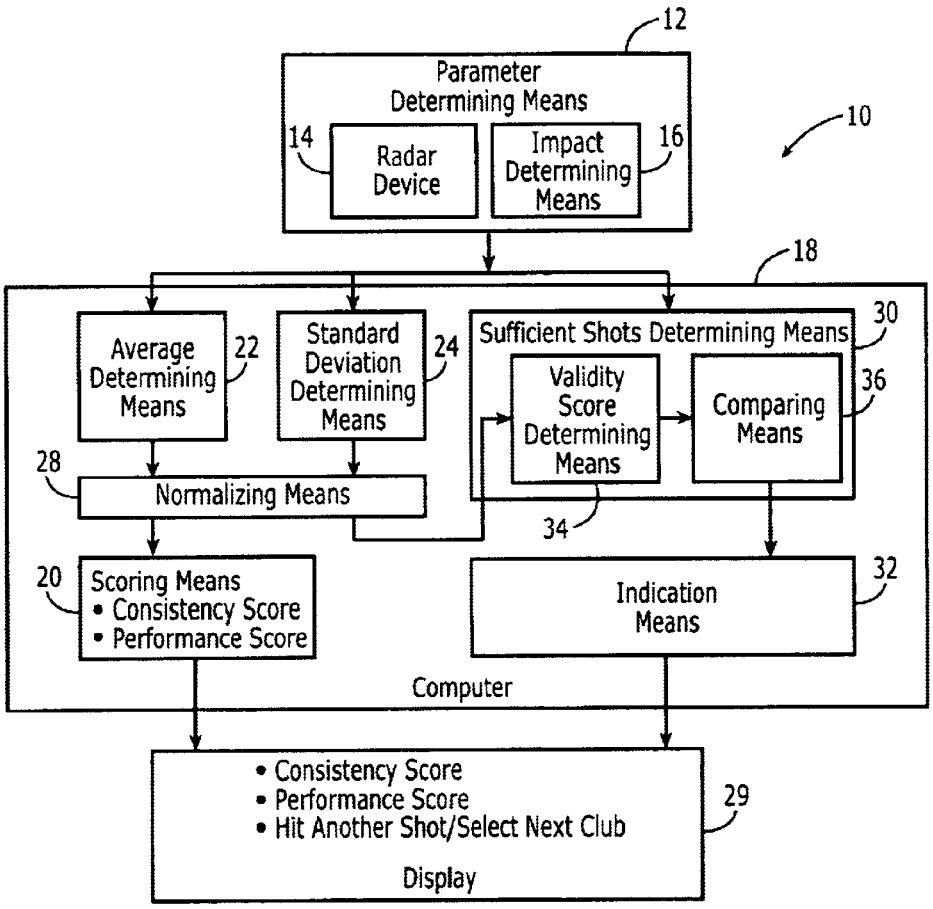
FIG. 3 is a block diagram of the club fitting system according to one embodiment of the present invention.
Figure 4:
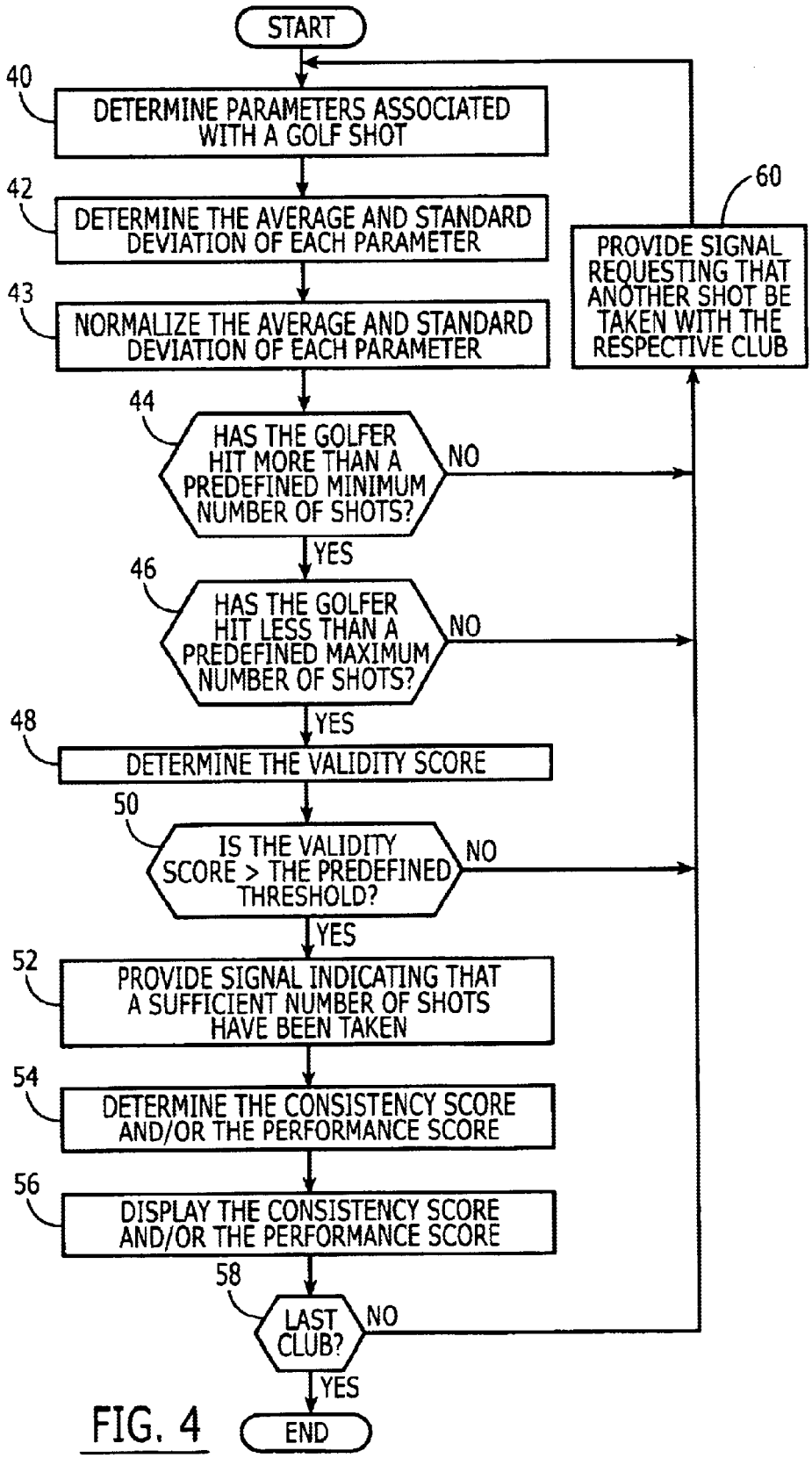
FIG. 4 is a flow chart illustrating the operations performed by the club fitting method and system of one embodiment of the present invention.

As shown in FIGS. 1–3, the club fitting method and system 10 of the present invention preferably includes means 12 for determining a plurality of different parameters associated with and defining a particular golf shot. See block 40 of FIG. 4. For example, the club fitting method and system of one embodiment includes means for determining each of the following parameters for each golf shot:

Distance downrange
Distance offline
Flight time
Average ball speed
Apogee of ball
Weight shift from one foot to the other foot
Club shaft vibration frequency before and after impact
Club shaft vibration amplitude before and after impact
Club face impact point
Club face rotation speed
Club head speed before impact
Club head speed after impact
Club head speed loss
Ball launch speed
Ball speed, club head speed loss ratio
Ball launch angle (up/down)
Ball launch angle (right/left)
Ball launch backspin
Ball launch sidespin However, the club fitting method and system can determine either a smaller subset of parameters or a number of different parameters if so desired. Typically, the parameters utilized by the club fitting method and system depend upon the type of sensors utilized to collect the parameters and the club fitting philosophy adopted by the system designer which dictates the relative contributions of the various parameters.

As described below and as shown in FIG. 1, the means 12 for determining a number of parameters associated with a golf shot measures most of the parameters in the window of time beginning shortly before the golf club strikes the golf ball and ending shortly after the golf ball is launched. However, the means for determining a number of parameters associated with a golf shot can also measure a number of parameters based upon the impact location of the golf ball within a landing area, such as the landing area of a practice range as shown in FIG. 2. Moreover, the means for determining the number of parameters associated with the golf shot can derive or otherwise mathematically determine a number of parameters based upon one or more of the measured parameters.

According to one embodiment, the means 12 for determining a number of parameters associated with a golf shot includes a radar-based measurement device 14, such as the radar-based measurement device sold by Distance Caddy Company, 3555 Stanford Road, Suite 207, Ft. Collins, Colo. 80525. For example, a radar-based measurement device, such as the Distance Caddy radar device can measure the club head speed before impact, the club head speed after impact, the ball launch speed, the ball launch angle (up/down), the ball launch angle (right/left), the ball launch backspin and the ball launch side spin.

The club fitting method and system 10 of one embodiment of the present invention can also include a impact determination system 16 for determining the impact location of the golf ball within a landing area, such as the landing area at a practice range. For example, the club fitting method and system of this aspect of the present invention can include an ACCUSHOT™ system provided by AccuSport, Inc. of Winston-Salem, N.C. Based upon the impact location, the ACCUSHOT™ system can measure, among other parameters, the distance downrange of the impact location, the distance offline of the impact location relative to a predefined target, the flight time of the golf shot and the apogee of the golf ball, such as whether the golf ball had a high, a medium or a low flight path. See, for example, U.S. Pat. No. 5,303,924 to James W. Kluttz et al. which describes an impact determination system that includes a number of acoustical sensors, the contents of which are incorporated herein in their entirety. See also U.S. Pat. No. 4,898,388 to Bryce P. Beard, III et al. which describes a system including a number of vibration sensors for determining the impact location of a golf ball and a display for providing a golfer with a visual representation of the relative position of the impact location with respect to a predetermined target.

The means 12 for determining a plurality of parameters also preferably includes means for calculating a number of other parameters associated with the golf shot based upon the measured parameters. As such, the means for determining a number of parameters associated with a golf shot also preferably includes a computer 18, a microprocessor or the like that operates under software control to receive the measured parameters and to calculate or otherwise determine several related parameters, such as the average ball speed, the club head speed loss, the ball speed and the club head speed loss ratio. More preferably, the means for determining a number of parameters associated with a golf shot includes a laptop computer or the like that can be readily carried within a briefcase, such as to a practice range, and which can be electrically connected to the measurement devices, such as a radar-based measurement device 14 as shown in FIG. 1 and/or an impact location determination system 16 as shown schematically in FIG. 2.

The club fitting method and system 10 of the present invention also includes scoring means 20 for automatically determining a consistency score and a performance score for each of the different golf clubs based upon the parameters associated with the plurality of golf shots made with each respective club. Although the scoring means typically relies upon parameters measured both during launch and upon impact of the golf ball, the scoring means of one advantageous embodiment can determine the consistency score and/or the performance score based entirely upon parameters measured during launch of the golf ball or entirely upon parameters measured upon impact of the golf ball in the landing area. As such, the scoring means of this advantageous embodiment need only include one type of measurement device for measuring or otherwise determining parameters associated with a golf shot.

According to one advantageous embodiment, the club fitting method and system 10 includes means 22 for determining the average of each of the parameters for the shots taken with each of the different golf clubs. See block 42 of FIG. 4. Thus, if a golfer takes five shots with each of three different 5 irons, the club fitting method and system preferably separately determines: (1) the average of each of the parameters for the five shots taken with the first 5 iron; (2) the average of each of the parameters for the five shots taken with the second 5 iron; and (3) the average of each of the parameters for the five shots taken with the third 5 iron.

In addition, the club fitting method and system 10 of the present invention also preferably includes means 24 for determining the standard deviation of each of the parameters for the shots taken with each of the different golf clubs. See block 42 of FIG. 4. Thus, if a golfer takes five shots with each of three different 5 irons, the club fitting method and system preferably separately determines: (1) the standard deviation of each of the parameters for the five shots taken with the first 5 iron; (2) the standard deviation of each of the parameters for the five shots taken with the second 5 iron; and (3) the standard deviation of each of the parameters for the five shots taken with the third 5 iron. Typically, the club fitting method and system stores the averages and standard deviations of each of the different parameters as a summary data set in memory associated with the computer 8, the microprocessor or the like as shown in FIG. 3.

Based upon the parameters associated with each of the golf shots and, more particularly, based upon the averages and standard deviations of the parameters associated with the golf shots taken with each of a number of different clubs, the club fitting method and system 10 and, more specifically, the scoring means 20 preferably determines the consistency score and the performance score for each respective golf club. See block 54 of FIG. 4. According to one advantageous embodiment, the scoring means determines the consistency score and the performance score based on the following equation:

$$score = \frac{1}{n-z}\sum_{i=1}^{n} w_i s_i \tag{1}$$

wherein score is a numerical value representative of either the consistency score or the performance score for a particular golf club, n is the total number of members of the summary data set, $s_i$ is a member of the summary data set such as an average or standard deviation value following normalization as described below, $w_i$ is a weighting factor based upon the relative importance of the respective parameters, and z is the number of members, such as the average or standard deviation values, from the summary data set which are weighted with a 0 value, i.e., the associated $w_i$ is 0.

By appropriately weighting the various averages and standard deviations in the summary data set, the club fitting method and system 10 of the present invention can determine both the consistency score and the performance score for a respective club from the foregoing equation. For example, the scoring means 20 typically determines the consistency score by more heavily weighting the standard deviations of the various parameters in the summary data set, while more lightly weighting the averages of the various parameters in the summary data set, such as by weighting the averages of the various parameters in the summary data set with a weighting factor of zero. Conversely, the scoring means preferably determines the performance score by more heavily weighting the averages of the various parameters in the summary data set and by more lightly weighting the standard deviations of the various parameters in the summary data set, such as by weighting the standard deviations of the various parameters in the summary data set with a weighting factor of zero.

The operator or system designer of the club fitting method and system 10 typically selects the weighting factors to reflect the relative importance of the averages and standard deviations of the various parameters to the resulting consistency or performance scores. Although any number of weighting factors can be utilized, the weighting factors typically range from −10 to +10 with a positive weighting factor increasing the resulting score and a negative weighting factor decreasing the resulting score. Since the club fitting method and system is generally configured to provide consistency and performance scores that increase to represent better consistency and higher performance, respectively, those parameters which have a negative weighting factor should be minimized in order to increase the resulting score. Conversely, those parameters that have a positive weighting factor should be maximized in order to increase the resulting score. In addition, a weighting factor of zero indicates that the associated parameter is not considered in determining the resulting score. Although the weighting factors can be assigned in a variety of manners, the weighting factors are typically assigned by the operator or system designer of the club fitting method and system based upon predefined formulas for determining consistency and performance provided by a respective golf club manufacturer and based primarily upon the relative importance of the various parameters to the consistency and performance scores.

Since a wide variety of parameters are measured, computed or otherwise determined by the club fitting method and system 10 of the present invention, the averages and standard deviations of the various parameters can vary widely from relatively small values to relatively large values. For example, the average ball launch backspin will generally be a relatively large value, such as about 3000 rpm to 8000 rpm, while the average ball launch angle (right/left) will generally be a relatively small number, such as within the range of +/−15°.

In order to prevent one or more of the parameters from unfairly dominating the resulting consistency and performance scores, the club fitting method and system 10 of the present invention preferably includes means 28 for normalizing the averages and standard deviations of the various parameters of the summary data set prior to determining the consistency score and/or the performance score. See block 43 of FIG. 4. Although the club fitting method and system can normalize the averages and standard deviations of the summary data set in a variety of fashions without departing from the spirit and scope of the present invention, the club fitting method and system of one advantageous embodiment includes three different normalization techniques which are selectively utilized based upon whether the averages and standard deviations: (1) increase to indicate more desirable results, such as in the case of the distance down range of the impact location from the tee box; (2) decrease to indicate more desirable results, such as in the instance of most standard deviation values; or (3) peak at a particular optimal value, such as ball launch angle (up/down).

With respect to parameters which increase to indicate more desirable results, the club fitting method and system 10 of this embodiment of the present invention includes means 28 for normalizing the averages and standard deviations of the various parameters as follows:

$$s_{normal} = \frac{s - s_{lower}}{s_{upper} - s_{lower}} \times 100 \tag{2}$$

wherein $s_{normal}$ is a normalized parameter representing a normalized average or standard deviation value, s is the parameter (average or standard deviation value) from the summary data set, $s_{upper}$ is a maximum value for the respective parameter, $s_{lower}$ is the minimum value for the respective parameter. As described above, $s_{upper}$ and $s_{lower}$ bound the range of permissible values for the respective parameter s and are chosen to expand that portion of the range of values that are most important to the consistency and/or performance scores. As such, the bounds $s_{upper}$ and $s_{lower}$ are referred to as normalizers. For example, ball launch back spin typically varies between 3000 rpm and 8000 rpm. By selecting $s_{upper}$ to equal 8000 rpm and $s_{lower}$ to equal 3000 rpm, the club fitting method and system 10 of this embodiment of the present invention and, more particularly, the foregoing equation can effectively convert the ball launch back spin values to a scale ranging from 0 to 100.

Correspondingly, the club fitting method and system 10 of the present invention can normalize a parameter that decreases as more desirable results are obtained as follows:

$$S_{normal} = 100 - \left(\frac{S - S_{lower}}{S_{upper} - S_{lower}} \times 100\right) \tag{3}$$

As such, the club fitting method and system 10 of this embodiment of the present invention will normalize a decreasing parameter to a value between 0 and 100 which increases as the parameter decreases. For example, as the standard deviation of a respective parameter decreases to thereby indicate a more consistent and therefore more favorable result, the club fitting method and system of this embodiment of the present invention will normalize the standard deviation to a value between 0 and 100 which increases to indicate decreases in the corresponding standard deviation.

Finally, the club fitting method and system 10 of one embodiment also includes means 28 for normalizing a parameter having an optimal value based upon an $x^2$ curve which "peaks" the parameter at a particular point. In this regard, parameters which have an optimal value can be normalized as follows:

$$s_{peak} = 100 - \left(\frac{(s_{optimal} - s)^2}{\text{width}} \times 100\right) \tag{4}$$

wherein $S_{peak}$ is the normalized value for the respective parameter that varies between 0 and 100 and that reaches a peak value therebetween, $s_{optimal}$ is the optimal value of the respective parameter and width is a measure of the range of allowable values along the $x^2$ curve and should have a value that is equal to the maximum value of $(S_{optimal}-S)^2$. For the ball launch backspin parameter that varies between 2000 rpm and 3000 rpm and has an optimum value of 2500 rpm, the width is equal to $500^2$, i.e., $(3000-2500)^2$.

Based upon the normalized and weighted parameters representing average and standard deviation values, the club fitting method and system 10 of the present invention determines the consistency and performance scores for a number of different golf clubs. While the club fitting method and system can determine the consistency and performance scores in a variety of different manners, depending upon the parameters that a golf professional believes are most important, the club fitting system and method of one embodiment determines the performance score based on five parameters that each have a peak value and are therefore normalized pursuant to equation (4). For example, the five parameters may be distance, flight time, ball speed, launch angle and ball launch backspin. With respect to the distance, the maximum and minimum distances for a particular golf club may be 190 yards and 130 yards, respectively, and the optimal distance may be 165 yards. For flight time, the maximum and minimum flight times may be 5.1 seconds and 4.2 seconds, respectively, and the optimal flight time may be 4.7 seconds. With respect to ball speed, the maximum and minimum ball speeds may be 175 mph and 100 mph, respectively, and the optimal ball speed may be 130 mph. For launch angle, the maximum and minimum launch angles may be 20° and 10°, respectively, and the optimum launch angle may be 15°. Finally, the maximum and minimum ball launch backspin may be 7000 rpm and 3000 rpm, respectively, and the optimum ball launch backspin may be 4500 rpm. Based upon the foregoing values, the average value of each parameter can be separately normalized pursuant to equation (4).

Once the parameters have been normalized, the club fitting system and method can determine the performance score pursuant to equation (1) in which n equals 4 and z equals 0. In one exemplary embodiment, the distance is weighted by 100, the flight time and ball speed are each weighted by 50, and the launch angle and ballspin are each weighted by 80. The club fitting system and method can also determine a consistency score, typically based upon the standard deviations of the same parameters, in a like fashion with appropriate maximums, minimums and optimal values selected for each parameter.

Figure 5A:
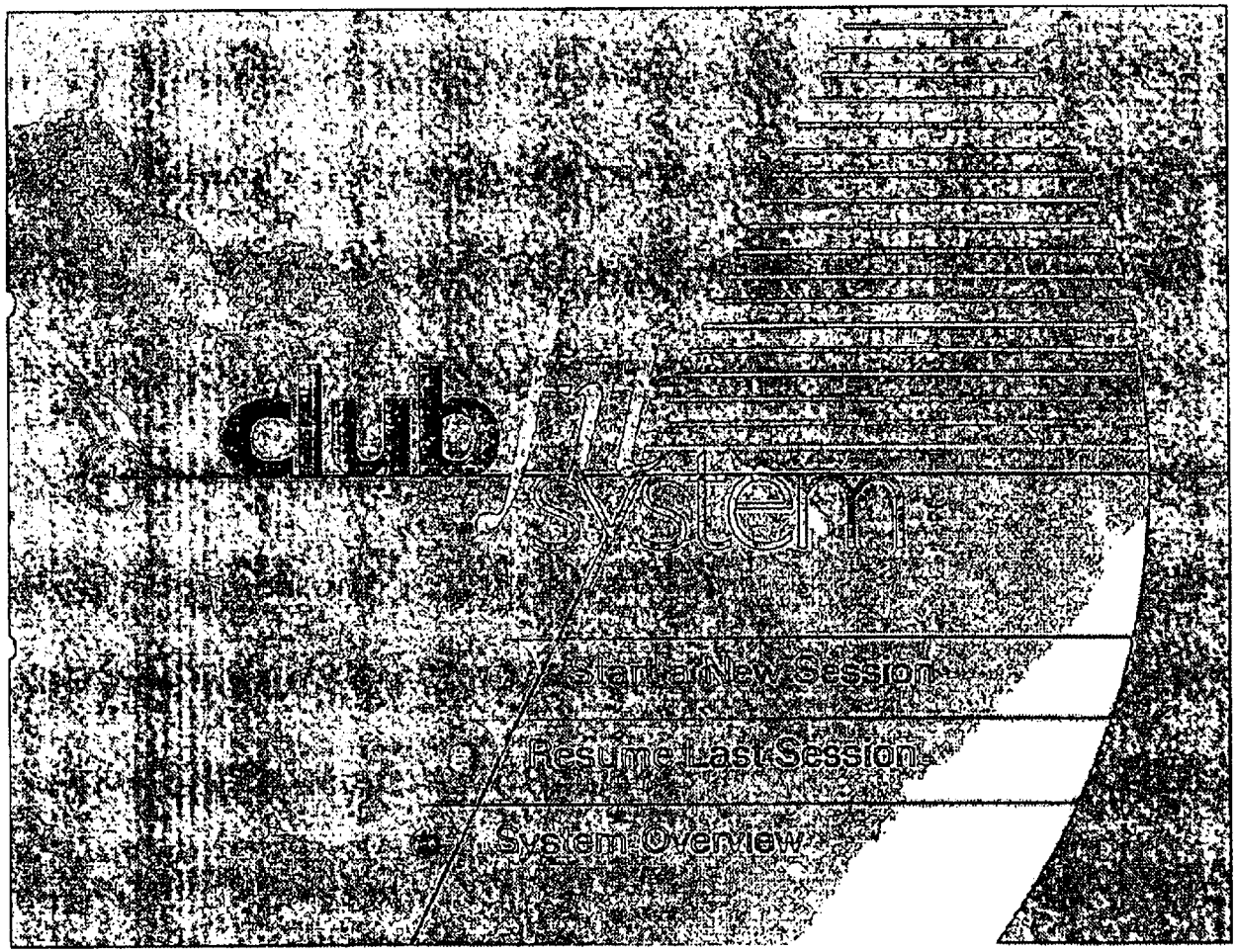
FIGS. 5A–5E are screen displays produced by the club fitting method and system of one advantageous embodiment of the present invention.
Figure 5B:
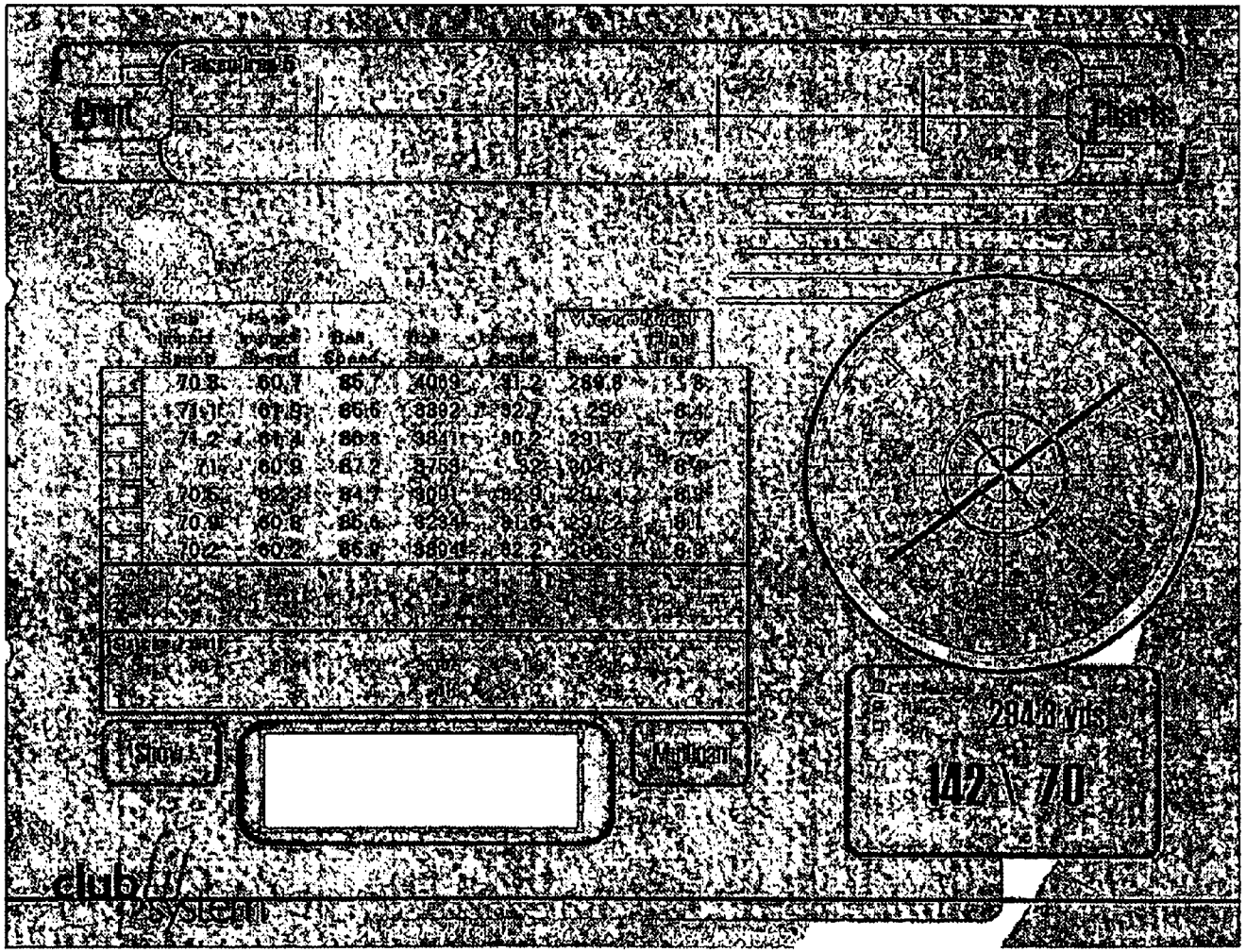
Figure 5C:
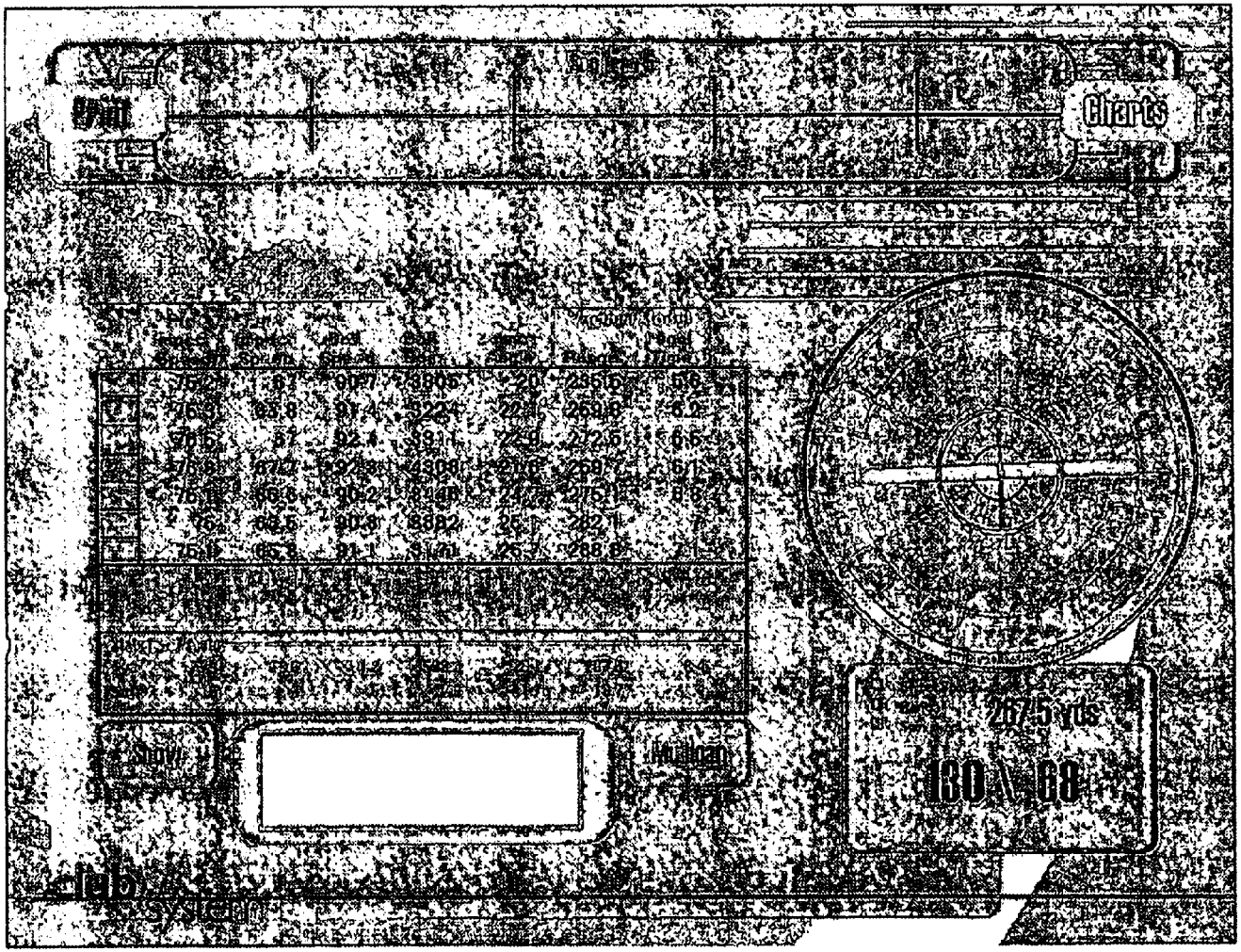
Figure 5D:
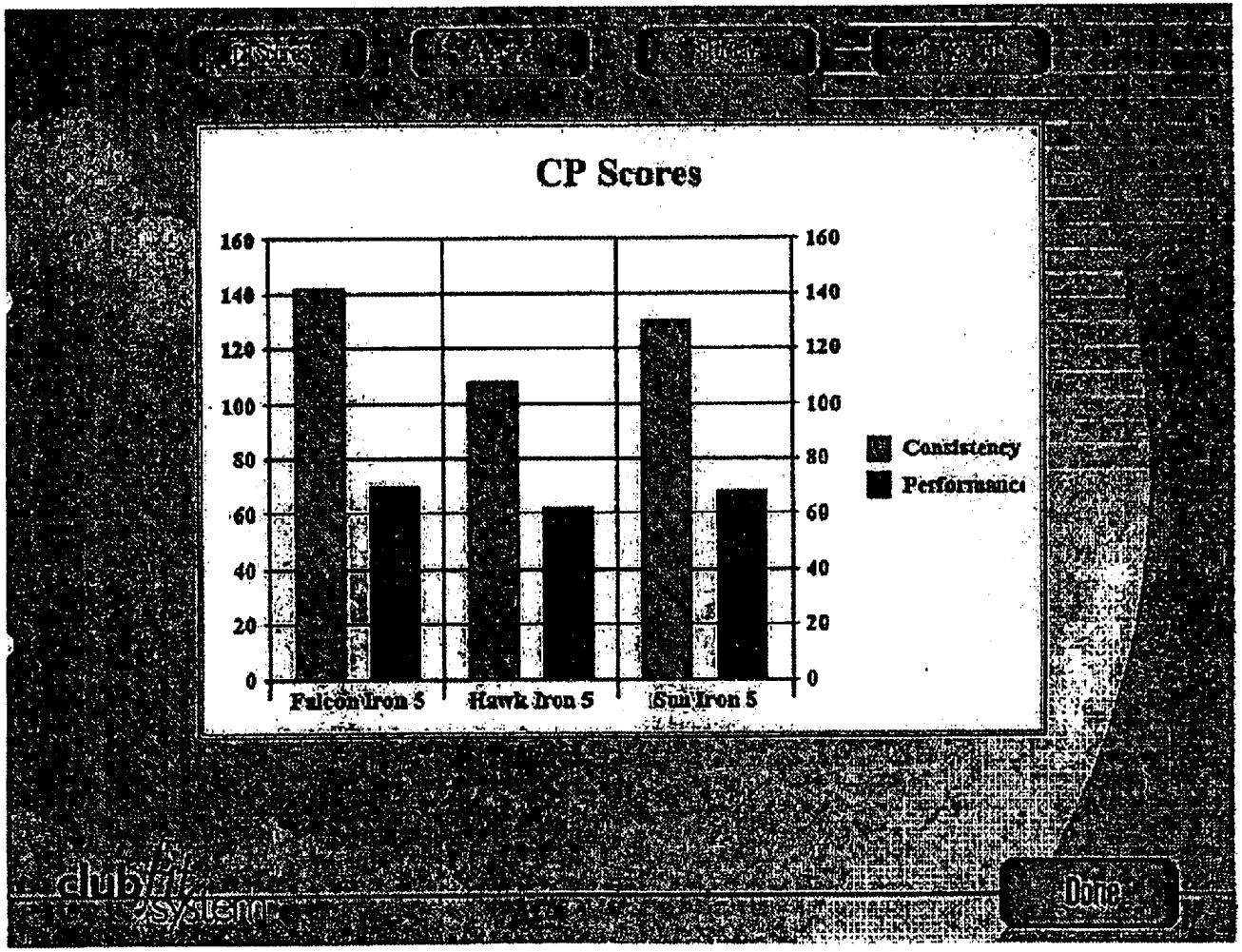
Figure 5E:
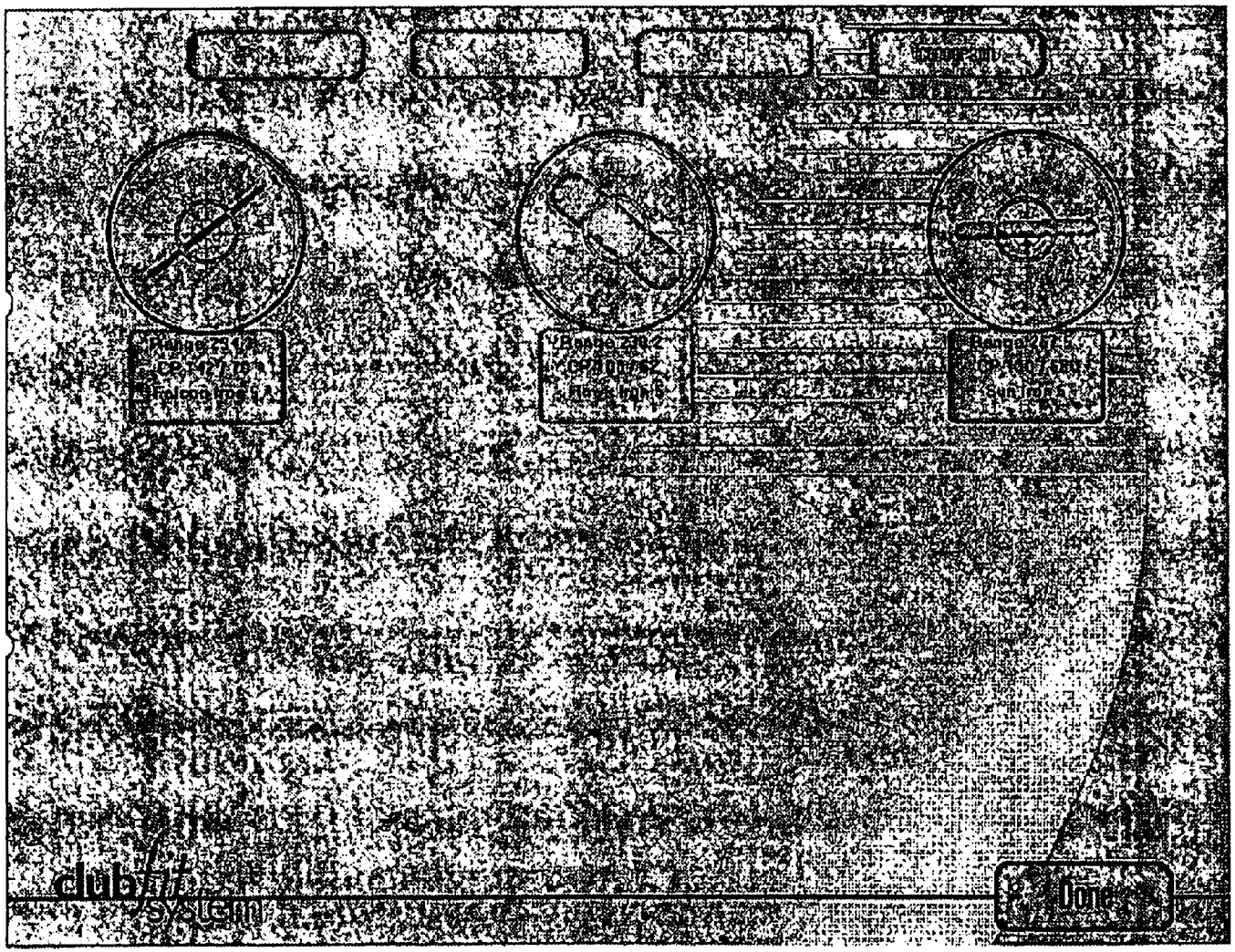
Figure 1:
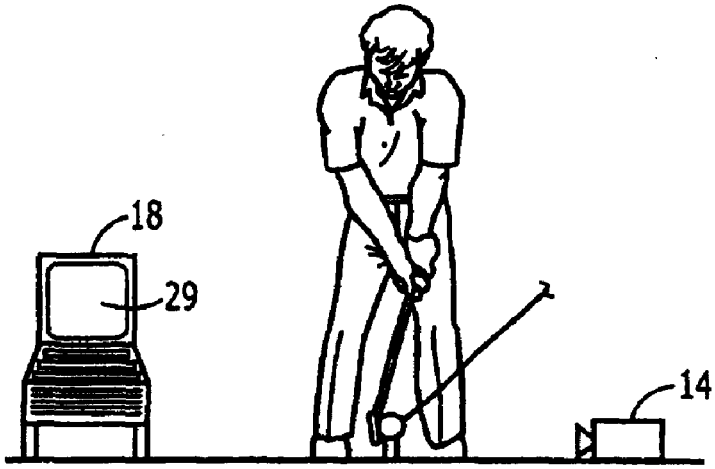
Figure 2:
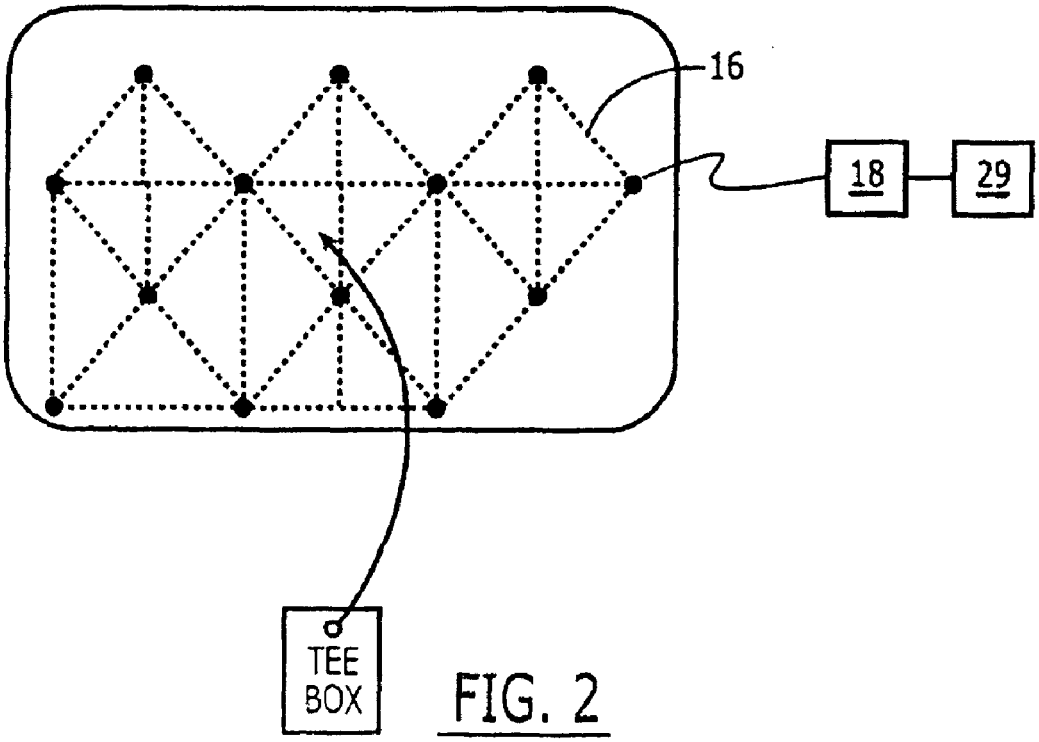
Figure 3:
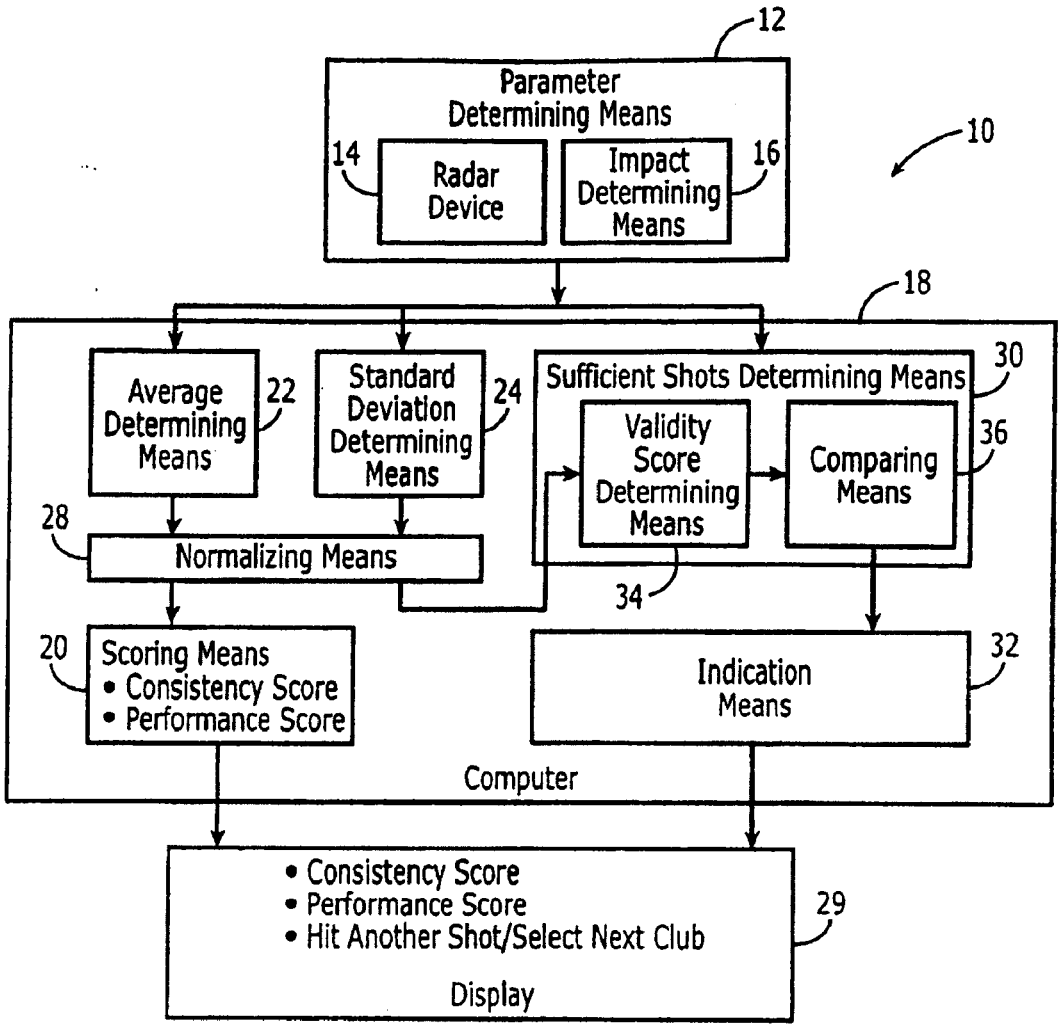
Figure 4:
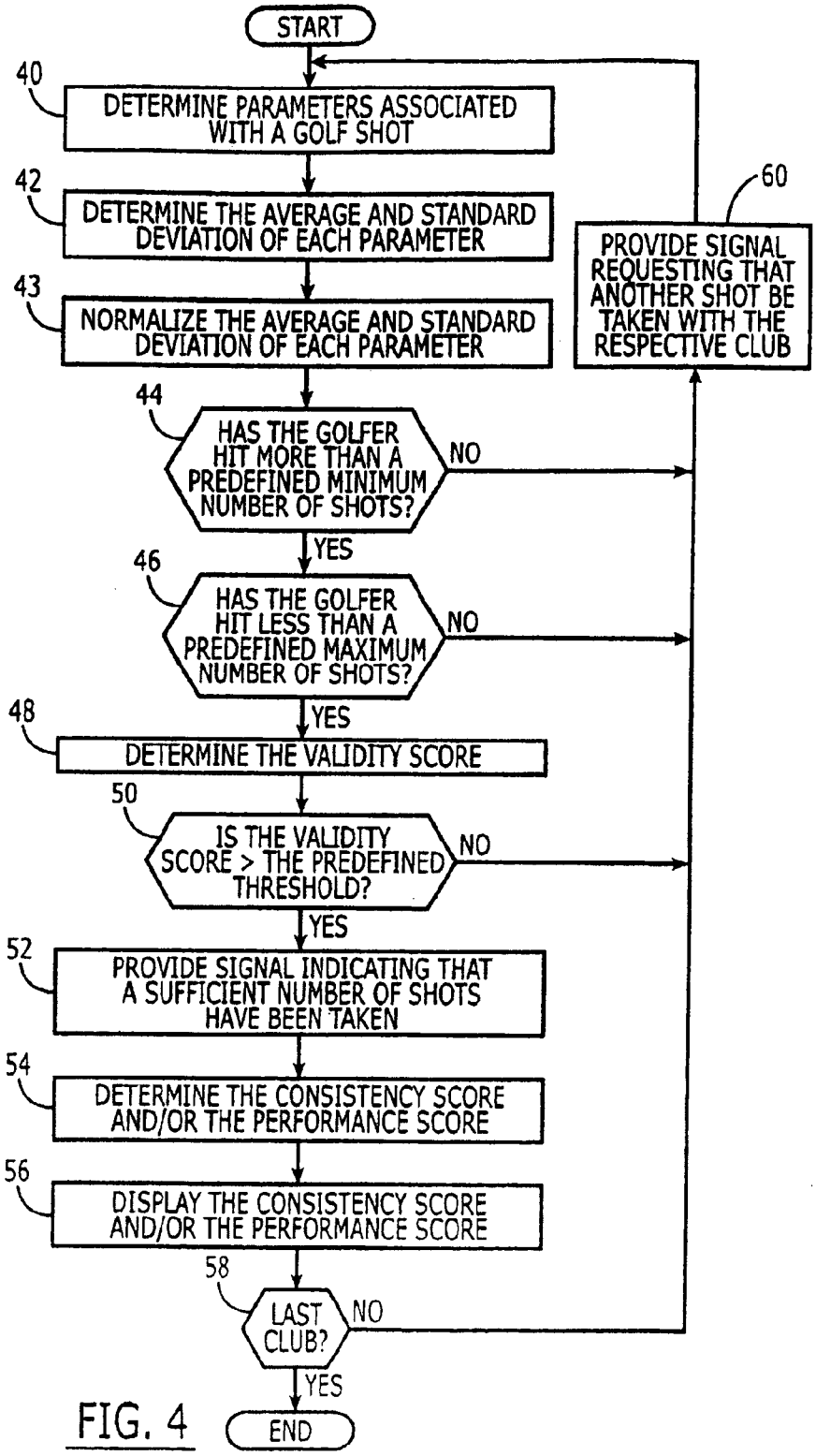
Figure 5A:
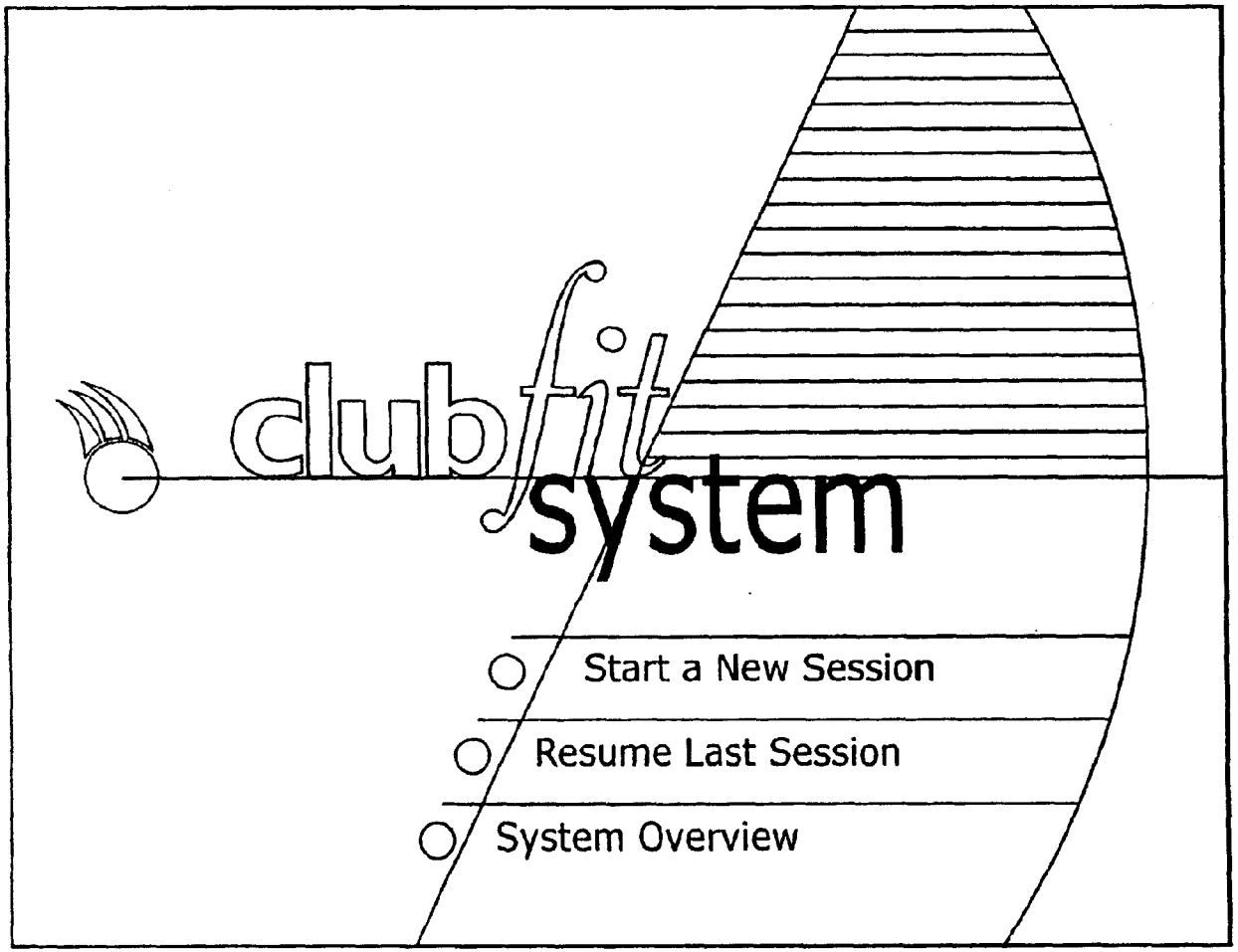
Figure 5B:
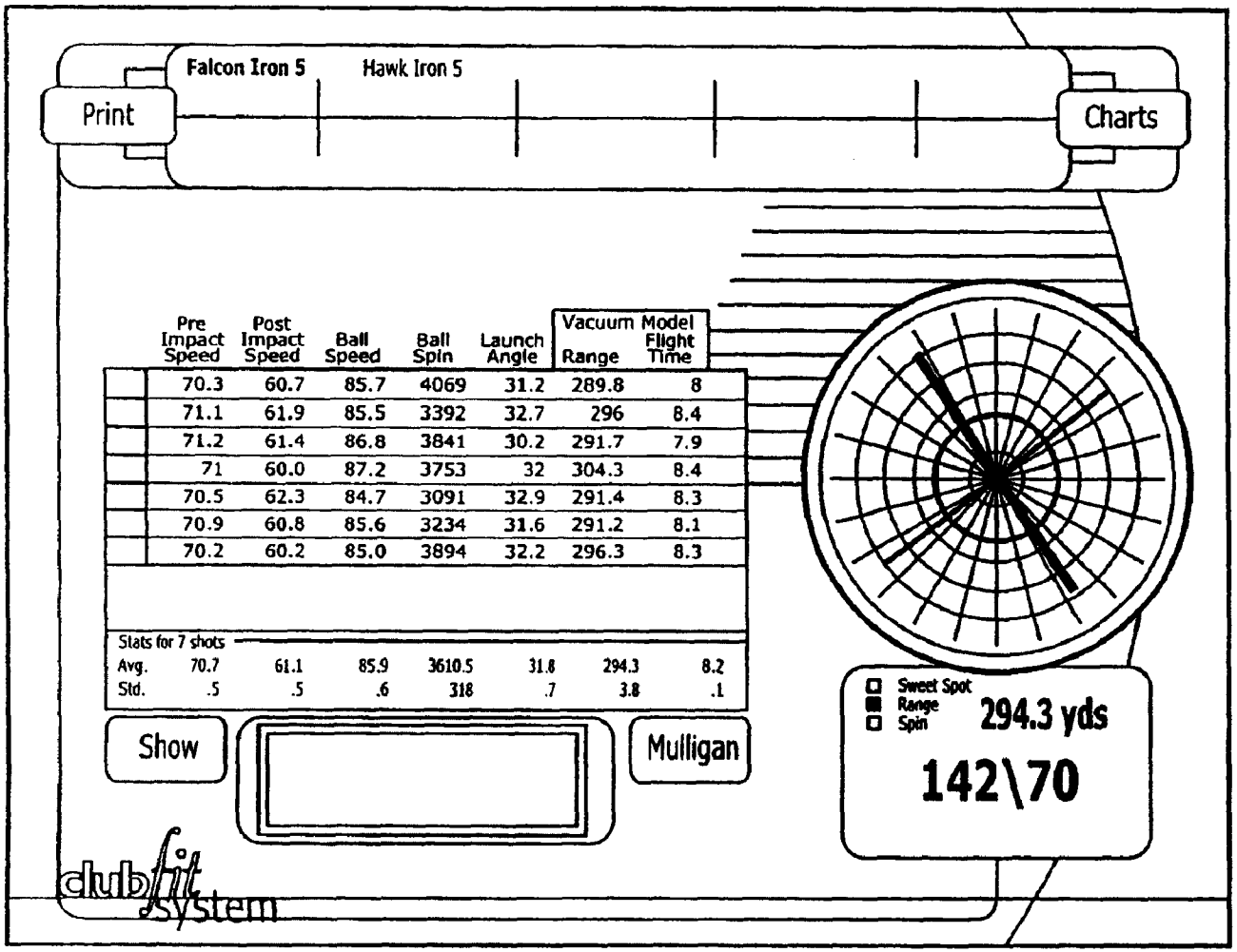
Figure 5C:
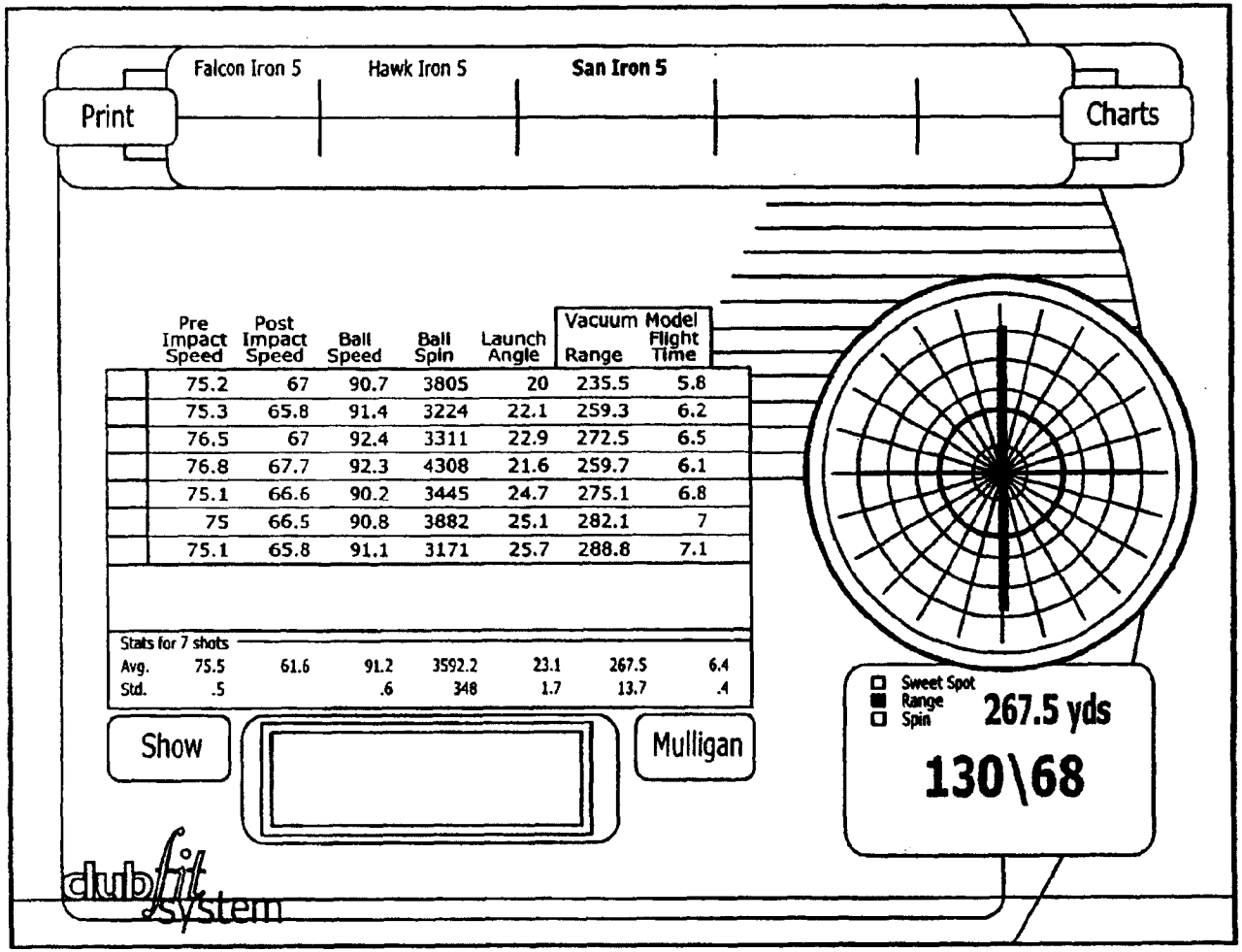
Figure 5D:
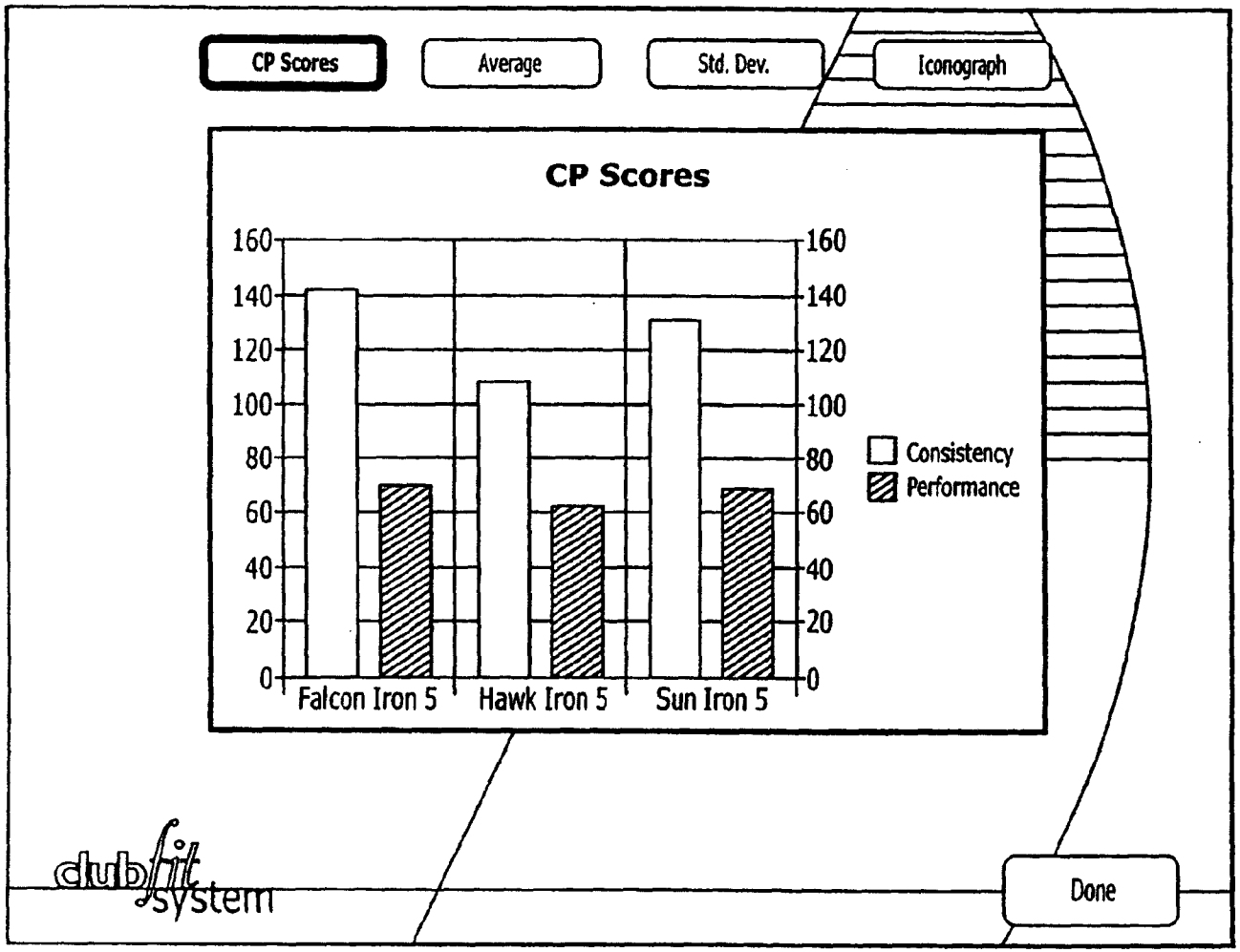
Figure 5E:
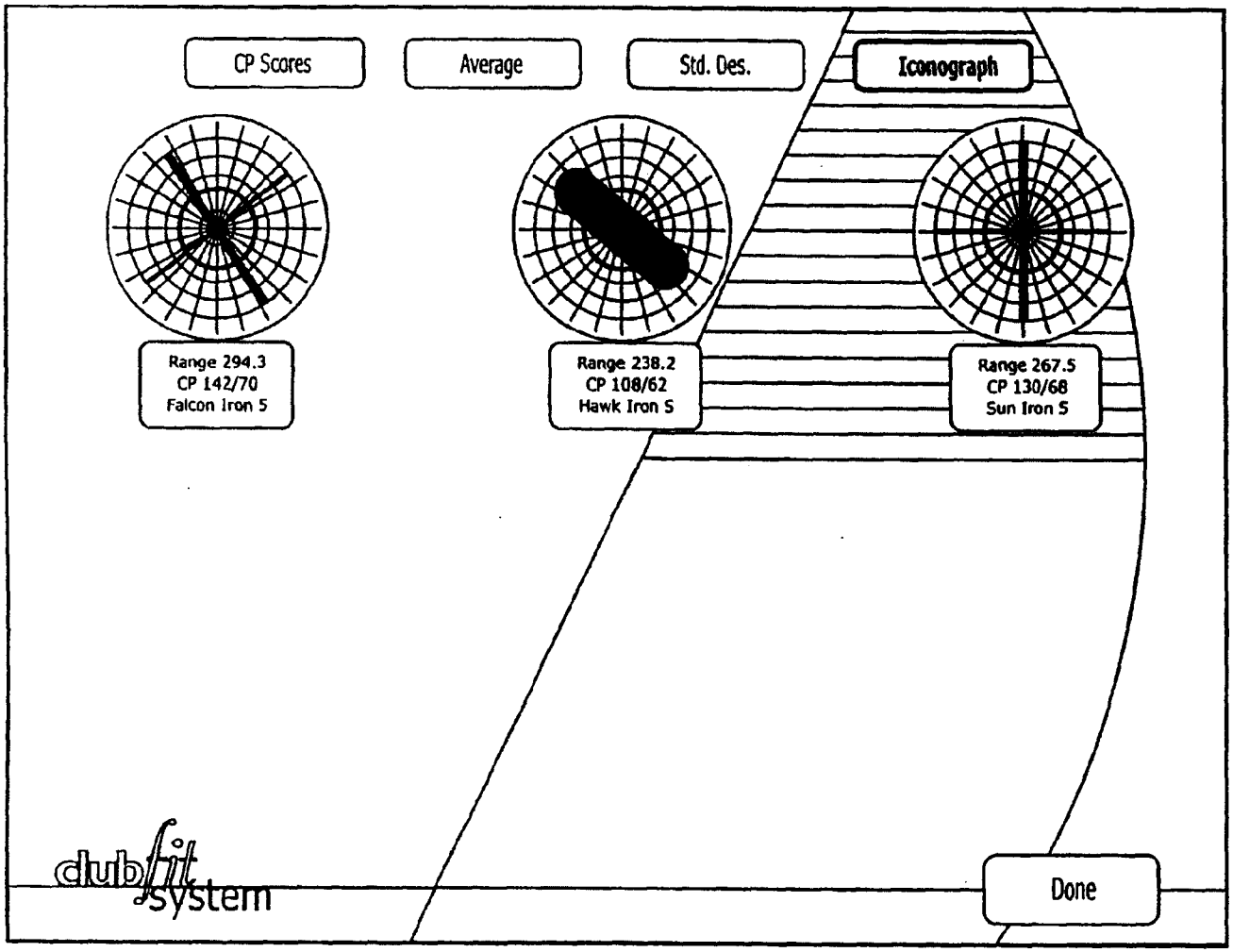

Throughout the club fitting session, the club fitting method and system generally presents the consistency and performance scores for the golf clubs that have been previously tested upon a display 29, such as computer monitor, associated with the scoring means 20. See block 56 of FIG. 4. Although the consistency and performance scores can be presented in a variety of formats without departing from the spirit and scope of the present invention, the club fitting method and system of one advantageous embodiments displays the consistency and performance scores as shown in the screen displays attached as FIGS. 5A–5E. As shown in FIGS. 5B and 5C, the display can present data collected during seven shots with a Falcon 5 iron and a Sun 5 iron, respectively, as well as the average and standard deviation of each of the respective parameters. Following the club fitting session, the consistency and performance scores for each club can be presented in a variety of formats as shown in FIGS. 5D and 5E. Armed with this information, a golfer can determine which golf club and, more particularly, which set of golf clubs best suits their game.

According to another aspect of the present invention, the club fitting method and system 10 includes means 30 for determining that a golfer has hit a sufficient number of golf shots with a respective golf club to determine the consistency and/or performance of the respective golf clubs. As such, the club fitting method and system of this embodiment also preferably includes means 32 for providing a signal or other indication to the golfer that no more shots need be made with the particular golf club. See block 52 of FIG. 4. The club fitting method and system of this embodiment can therefore prevent the golfer from making excessive shots with each golf club which could potentially tire a golfer and adversely affect the results of the club fitting session, particularly with respect to those golf clubs that are tested in the later portion of the club fitting session. In addition, the club fitting method and system of this embodiment can also provide a message, such as via the display 29, that indicates that at least one more shot should be made with the respective golf club if it is determined that the golfer has not yet made a sufficient number of shots. See block 60 of FIG. 4.

In order to determine when the golfer has made a sufficient number of shots with a respective golf club to determine the consistency and/or performance of the respective golf club, the club fitting method and system 10 defines a minimum number of shots which always must be taken, such as three golf shots, and a maximum number of shots that can be taken, such as seven golf shots. See blocks 44 and 46 of FIG. 4. In addition, the club fitting method and system of this embodiment defines a threshold value or a threshold value function representative of a level of consistency in the golfer's swing that is acceptable. Typically, the predefined threshold decreases as a golfer takes more shots with a respective club since a golfer's swing may just be consistently inconsistent, as reflected in the following table:

| # of Shots | Threshold Value |
|---|---|
| 3 | 90 |
| 4 | 80 |
| 5 | 70 |
| 6 | 60 |

Typically, the means 30 for determining that a golfer has made a sufficient number of shots with a respective golf club includes means 34 for determining a validity score for a respective golf club which is indicative of the consistency of the golfer's swing and which can be utilized to determine if a sufficient number of golf shots have been made with a respective golf club. See block 48 of FIG. 4. While the validity score may be based upon the derivative of the standard deviation of one or more of the parameters, the means for determining a validity score according to one exemplary embodiment utilizes equation (1) as described above with weighting factors assigned such that the resulting validity score is a reflection of the consistency of the golfer's swing, as opposed to the performance and/or consistency of a particular golf club. Since the means for determining that a sufficient number of shots have been made with a respective golf club analyzes the consistency of the golfer's swing, the club fitting method and system 10 of this embodiment generally weights all of the average values of the summary data set with a 0 weighting factor while weighting at least some of the standard deviations with non-zero weighting factors. As such, the resulting validity score is generally based primarily, if not entirely, upon the standard deviations of a number of different parameters.

In order to gauge the consistency of a golfer's swing as opposed to the consistency and performance of a particular club, the parameters that are more directly related to a golfer's swing, irrespective of the particular golf club, are preferably weighted more heavily. For example, the club face impact point and the weight shift from one foot to the other foot are closely related to the consistency of a golfer's swing and are therefore generally weighted relatively heavily. Conversely, the parameters that are more directly related to a particular golf club, such as the ball launch angle (up/down), as opposed to a golfer's swing, are preferably weighted more lightly, if at all.

The club fitting method and system 10 of this aspect of the present invention also includes means 36 for comparing the validity score derived by the foregoing equation with the predefined threshold based upon the number of golf shots that a golfer has made with the respective golf club. See block 50 of FIG. 4. For example, for a golfer that has hit a particular golf club four times, the club fitting method and system of this embodiment would compare the resulting validity score to the predefined threshold of 80 and would provide a signal to the golfer that a sufficient number of shots had been taken with the respective club and that the next club could now be tested if the validity score exceeded the predefined threshold. As such, the club fitting method and system of this embodiment of the present invention reduces the likelihood that a golfer will significantly tire before completing a club fitting session, thereby obtaining data representative of the golfer's true abilities throughout the entire session.

Instead of calculating a validity score, the means 30 for determining that a golfer has made a sufficient number of shots can, instead, determine the consistency score following each shot and the difference between the current consistency score and the immediately preceding consistency score, i.e., the consistency score prior to the most recent shot. Typically, the difference between the current consistency score and the immediately preceding consistency score decreases as additional shots are taken. In any event, this difference can then be compared to a preset value following each shot and a signal indicative that the golfer has taken a sufficient number of shots can be provided once the difference between the two most recent consistency scores is less than the preset values.

As described above, the means 30 for determining that a golfer has made a sufficient number of shots with a respective golf club typically comprises a computer 18, a microprocessor or the like that operates under software control. As a result, the means 32 for providing the operator with an indication that a sufficient number of shots have been made with a respective golf club generally includes a computer generated audio or visual signal. Upon receiving the indication, the golfer can determine if all clubs have been tested as shown in block 58 of FIG. 4 and, if not, can change golf clubs before hitting an excessive number of golf shots with the preceding golf club, thereby permitting the club fitting session to proceed more efficiently.

In the drawings and the specification, there has been set forth a preferred embodiment of the invention and, although specific terms are employed, the terms are used in a generic and descriptive sense only and not for purpose of limitation, the scope of the invention being set forth in the following claims.

That which is claimed is:

1. A method for assisting a golfer in the selection of a set of golf clubs, wherein the golfer makes a plurality of golf shots with each of a plurality of golf clubs from a plurality of sets of golf clubs, and wherein the method comprises:

determining a plurality of parameters associated with each golf shot, wherein the plurality of parameters are selected from the group consisting of parameters associated with striking of a golf ball, parameters based upon an impact location of the golf ball and parameters derived from at least one of the parameters associated with the striking of the golf ball and the parameters based upon the impact location of the golf ball; and automatically determining at least one of a consistency score for a respective golf club based upon individually weighted representations of respective standard deviations of the plurality of parameters associated with the plurality of golf shots made with the respective club and a performance score for a respective golf club based upon individually weighted representations of respective averages of the plurality of parameters associated with the plurality of golf shots made with the respective club to thereby enable the golfer to select the set of golf clubs based upon at least one of the consistency score and the performance score.

2. A method according to claim 1 further comprising determining the standard deviation for respective ones of the parameters.

3. A method according to claim 2 wherein said automatic determination of the consistency score for a respective golf club comprises normalizing the standard deviations for respective ones of the parameters associated with the plurality of golf shots made with the respective club.

4. A method according to claim 1 further comprising determining the average for respective ones of the parameters.

5. A method according to claim 4 wherein said automatic determination of the performance score for a respective golf club comprises normalizing the averages for respective ones of the parameters associated with the plurality of golf shots made with the respective club.

6. A method according to claim 1 wherein said automatic determination of at least one of the consistency score and the performance score for the respective golf club automatically determines the consistency score and the performance score for the respective club based upon parameters associated with launch conditions of the golf shots and independent of parameters associated with the landing of the golf shots.

7. A method for assisting a golfer in the selection of a set of golf clubs, wherein the golfer makes a plurality of golf shots with each of a plurality of golf clubs of the same type chosen from different sets of golf clubs, wherein each golf shot is defined by a plurality of parameters selected from the group consisting of parameters associated with striking of a golf ball, parameters based upon an impact location of the golf ball and parameters derived from at least one of the parameters associated with the striking of the golf ball and the parameters based upon the impact location of the golf ball, and wherein the method comprises:

determining a standard deviation for respective ones of the parameters that define each golf shot; and determining a consistency score for golf club of the same type that is based upon individually weighted representations of the respective standard deviations for the plurality of parameters associated with the plurality of golf shots made with the respective club to thereby enable the golfer to select the set of golf clubs based upon the consistency score.

8. A method according to claim 7 wherein said determination of the consistency score comprises normalizing the standard deviations for respective ones of the parameters associated with the plurality of golf shots made with the respective club.

9. A method according to claim 7 wherein said determination of the consistency score for the respective golf club determines the consistency score based upon parameters associated with launch conditions of the golf shots and independent of parameters associated with the landing of the golf shots.

10. A method for assisting a golfer in the selection of a set of golf clubs, wherein the golfer makes a plurality of golf shots with each of a plurality of golf clubs from a plurality of sets of golf clubs, wherein each golf shot is defined by a plurality of parameters selected from the group consisting of parameters associated with striking of a golf ball, parameters based upon an impact location of the golf ball and parameters derived from at least one of the parameters associated with the striking of the golf ball and the parameters based upon the impact location of the golf ball, and wherein the method comprises:

automatically determining that a sufficient number of golf shots have been made with a respective golf club based upon at least some of the plurality of parameters associated with each golf shot, wherein said automatic determination comprises: determining a validity score for a respective golf club that is indicative of the consistency of a golfer's swing and is at least partially based upon standard deviations of respective ones of the parameters associated with the plurality of golf shots made with the respective club; and comparing the validity score to a predefined threshold to determine if a sufficient number of golf shots have been made with the respective golf club; and providing an indication to the golfer that the golfer has made a sufficient number of golf shots the respective golf club.

11. A method according to claim 10 wherein the predefined threshold varies in a predetermined manner based upon the number of golf shots that have been made with the respective golf club.

12. A method according to claim 10 wherein said automatic determination that a sufficient number of golf shots have been made with the respective golf club requires at least a predetermined minimum number, but no more than a predetermined maximum number of golf shots to be made with the respective golf club.

* * * * *

UNITED STATES PATENT AND TRADEMARK OFFICE

CERTIFICATE OF CORRECTION

PATENT NO. : 6,966,843 B2
APPLICATION NO. : 09/305396
DATED : November 22, 2005
INVENTOR(S) : Rankin et al.

It is certified that error appears in the above-identified patent and that said Letters Patent is hereby corrected as shown below:

Drawings,

Drawings should be deleted to be substituted with the attached drawings.

Signed and Sealed this

Tenth Day of October, 2006

JON W. DUDAS
*Director of the United States Patent and Trademark Office*